US007792452B2

(12) United States Patent
Fujikura

(10) Patent No.: US 7,792,452 B2
(45) Date of Patent: Sep. 7, 2010

(54) IMAGE FORMING APPARATUS

(75) Inventor: Shuichi Fujikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 423 days.

(21) Appl. No.: 12/000,497

(22) Filed: Dec. 13, 2007

(65) Prior Publication Data

US 2008/0187341 A1 Aug. 7, 2008

(30) Foreign Application Priority Data

Dec. 22, 2006 (JP) ..... 2006-345706

(51) Int. Cl.
*G03G 15/20* (2006.01)

(52) U.S. Cl. ..... 399/69

(58) Field of Classification Search ..... 399/13, 399/23, 44, 45, 69, 94
See application file for complete search history.

(56) References Cited

U.S. PATENT DOCUMENTS 5,162,845 A * 11/1992 Ariyama et al. ..... 399/13
5,365,311 A * 11/1994 Matsuoka ..... 399/13
5,486,903 A * 1/1996 Kanno et al. ..... 399/45
5,512,992 A * 4/1996 Kim et al. ..... 399/69
5,991,563 A * 11/1999 Haneda et al. ..... 399/68
2004/0264992 A1* 12/2004 Shiraishi ..... 399/69
2006/0120738 A1* 6/2006 Bartley et al. ..... 399/45

FOREIGN PATENT DOCUMENTS

JP 07-181833 7/1995
JP 10-171192 6/1998

* cited by examiner

*Primary Examiner*—David P Porta
*Assistant Examiner*—Marcus H Taningco
(74) *Attorney, Agent, or Firm*—Kubotera & Associates LLC

(57) ABSTRACT

An image forming apparatus includes a fixing device for thermally fixing the image on the recording medium; a medium type detection unit for detecting a type of recording medium; a temperature adjusting unit for adjusting a temperature of the fixing device according to the type of recording medium; and a storage unit for storing data indicating the type of recording medium. The temperature adjusting unit sets a target temperature according to the type of recording medium stored in the storage unit and starts heating the fixing device. After the temperature adjusting unit sets the target temperature and starts heating the fixing device, the temperature adjusting unit determines whether to change the target temperature according to a comparison result between a type of recording medium newly detected by the medium type detection unit and the type of recording medium indicated by the data stored in the storage unit.

9 Claims, 11 Drawing Sheets

| Type of recording sheet | Thickness of recording sheet | Transportation (printing) speed (ppm) | | Range of sheet thickness (μm) | Fixing temperature (°C) |
|---|---|---|---|---|---|
| | | Color | Monochrome | | |
| Normal | Light | 36 | 40 | 70≤ <85 | 190 |
| | Medium Light | 36 | 40 | 85≤ <95 | 195 |
| | Medium | 36 | 40 | 95≤ <110 | 195 |
| | Medium Heavy | 26 | 26 | 110≤ <125 | 180 |
| | Heavy | 26 | 26 | 125≤ <160 | 180 |
| | Ultra Heavy | 23 | 23 | 160≤ <190 | 180 |
| | Special Heavy | 20 | 20 | 190≤ | 180 |

FIG. 6

IMAGE FORMING APPARATUS

BACKGROUND OF THE INVENTION

The present invention relates to an image forming apparatus for forming an image on a specific recording medium according to input data.

In a conventional image forming apparatus, before an image forming process is conducted, a thickness of a recording medium to be printed is measured, and a process value suitable for the thickness is determined. More specifically, in a conventional image forming apparatus, a table containing an optimized transfer voltage, an optimized developing voltage, an optimized fixing temperature, and the likes is created in advance. According to a thickness of a recording medium, a process value such as a transfer voltage, a developing voltage, a fixing temperature, and the likes is determined with reference to the table (refer to Patent Reference).

In the conventional image forming apparatus, every time when a recording medium is supplied, a thickness thereof is measured. Alternatively, only the first one of recording media stored in a sheet supply tray is measured. In the conventional image forming apparatus, it is necessary to stop a recording medium for measuring a thickness thereof. Accordingly, every time when a thickness of a medium is measured, a process time is delayed by about 0.5 second. For this reason, in most cases, unless a sheet supply tray is exchanged, only a first one of recording media stored in a sheet supply tray is measured under an assumption that a same type of recording media are stored in the sheet supply tray.

Patent Reference; Japanese Patent Publication No. 10-171192

In the conventional image forming apparatus, it is difficult to determine whether a sheet supply tray is exchanged when the image forming apparatus is turned on. Accordingly, it is necessary to always measure a thickness of the first one of recording media, thereby taking a long period of time to form an image on the first one of the recording media.

Further, in the conventional image forming apparatus, a fixing device is heated up to a temperature suitable for a thickness of a recommended sheet upon turning on the power, so that it is possible to start an image forming operation immediately after the power is turned on. Accordingly, it takes a long period of time to heat up the fixing device. Further, in the conventional image forming apparatus, when the temperature of the fixing device exceeds a target temperature, it is necessary to take 30 seconds to one minute for decreasing the temperature (cooling down the fixing device).

Further, depending on an area, a location, or a country, a recording medium having a thickness smaller than that of the recommended sheet may be commonly used. In this case, when the image forming apparatus forms an image on the first sheet after the power is turned on, it is necessary to cool the fixing device, thereby causing at least 30 seconds time loss.

Recently, in order to reduce power consumption, many users tend to turn off the image forming apparatus more frequently, and the image forming apparatus may be provided with a sleep mode. In this case, after the power is turned on, or the image forming apparatus returns from the sleep mode, it takes a long period of time to form an image on the first recording medium.

In view of the problems described above, an object of the invention is to provide an image forming apparatus capable of forming an image on a first recording medium in a short period of time after the power is turned on, or the image forming apparatus returns from the sleep mode.

Further objects and advantages of the invention will be apparent from the following description of the invention.

SUMMARY OF THE INVENTION

In order to attain the objects described above, according to a first aspect of the present invention, an image forming apparatus forma an image on a specific recording medium according to input data. The image forming apparatus includes a fixing device for thermally fixing the image on the recording medium; a medium type detection unit for detecting a type of recording medium; a temperature adjusting unit for adjusting a temperature of the fixing device according to the type of recording medium detected by the medium type detection unit; and a non-volatile storage unit for storing data indicating the type of recording medium detected by the medium type detection unit.

Further, the temperature adjusting unit sets a target temperature according to the type of recording medium stored in the storage unit and starts heating the fixing device. After the temperature adjusting unit sets the target temperature and starts heating the fixing device, the temperature adjusting unit determines whether to change the target temperature according to a comparison result between a type of recording medium newly detected by the medium type detection unit and the type of recording medium indicated by the data stored in the storage unit.

In the first aspect of the present invention, the temperature adjusting unit sets the target temperature according to the type of recording medium stored in the storage unit and starts heating the fixing device. After the temperature adjusting unit sets the target temperature and starts heating the fixing device, the temperature adjusting unit determines whether to change the target temperature according to a comparison result between a type of recording medium newly detected by the medium type detection unit and the type of recording medium indicated by the data stored in the storage unit. Accordingly, when the recording sheet different from a recommended sheet is used, and it is determined that the recording sheet is not changed according to a detection result of the type of recording medium after the power is turned on or the image forming apparatus returns from a sleep state for performing a printing operation, it is not necessary to reset the target temperature.

According to a second aspect of the present invention, an image forming apparatus forma an image on a specific recording medium according to input data. The image forming apparatus includes a fixing device for thermally fixing the image on the recording medium; a medium type detection unit for detecting a type of recording medium; and a temperature adjusting unit for adjusting a temperature of the fixing device according to the type of recording medium detected by the medium type detection unit.

Further, the temperature adjusting unit sets a target temperature according to a recording medium to be fixed at a lowest temperature among the recording media detectable with the medium type detection unit and starts heating the fixing device. After the temperature adjusting unit sets the target temperature and starts heating the fixing device, the temperature adjusting unit determines whether to change the target temperature according to a type of recording medium newly detected by the medium type detection unit.

In the second aspect of the present invention, the temperature adjusting unit sets the target temperature according to the recording medium to be fixed at the lowest temperature among the recording media detectable with the medium type detection unit and starts heating the fixing device. After the temperature adjusting unit sets the target temperature and starts heating the fixing device, the temperature adjusting unit determines whether to change the target temperature according to the type of recording medium newly detected by the medium type detection unit. Accordingly, when the recording sheet different from the recommended sheet is used, and it is determined that the recording sheet is not changed according to the detection result of the type of recording medium after the power is turned on or the image forming apparatus returns from the sleep state for performing a printing operation, it is not necessary to reset the target temperature. Further, the temperature adjusting unit does not set the target temperature through retrieving data from a storage unit. Accordingly, it is possible to make a process simple and efficiently perform a process suitable for an actual situation in which the recording medium is not frequently changed.

According to a third aspect of the present invention, an image forming apparatus forma an image on a specific recording medium according to input data. The image forming apparatus includes a fixing device for thermally fixing the image on the recording medium; a medium type detection unit for detecting a type of recording medium; a temperature adjusting unit for adjusting a temperature of the fixing device according to the type of recording medium detected by the medium type detection unit; a medium storage unit for storing the recording medium; and a detachment detection unit for detecting whether the medium storage unit is detached from the image forming apparatus.

Further, the temperature adjusting unit sets a target temperature and starts heating the fixing device. After the temperature adjusting unit sets the target temperature and starts heating the fixing device, the temperature adjusting unit determines whether to change the target temperature according to a detection result of the detachment detection unit.

In the third aspect of the present invention, the temperature adjusting unit sets the target temperature and starts heating the fixing device. After the temperature adjusting unit sets the target temperature and starts heating the fixing device, the temperature adjusting unit determines whether to change the target temperature according to the detection result of the detachment detection unit. Accordingly, when the recording sheet different from the recommended sheet is used, and it is determined that the medium storage unit is not detached, it is not necessary to reset the target temperature after the power is turned on or the image forming apparatus returns from the sleep state for performing a printing operation.

In the image forming apparatus of the present invention, when it is determined that the recording medium is not changed, it is not necessary to reset the target temperature. Accordingly, it is possible to significantly reduce a time for forming an image on a first one of recording media after the power is turned on or the image forming apparatus returns from the sleep state.

BRIEF DESCRIPTION OF THE DRAWINGS

FIG. 6 is a view showing a table stored in an ROM of the printer according to the first embodiment of the present invention;

DETAILED DESCRIPTION OF PREFERRED EMBODIMENTS

Hereunder, embodiments of the present invention will be explained with reference to the accompanying drawings. A printer will be explained as an image forming apparatus for forming an image on a specific recording medium according to input data.

First Embodiment

Figure 1:
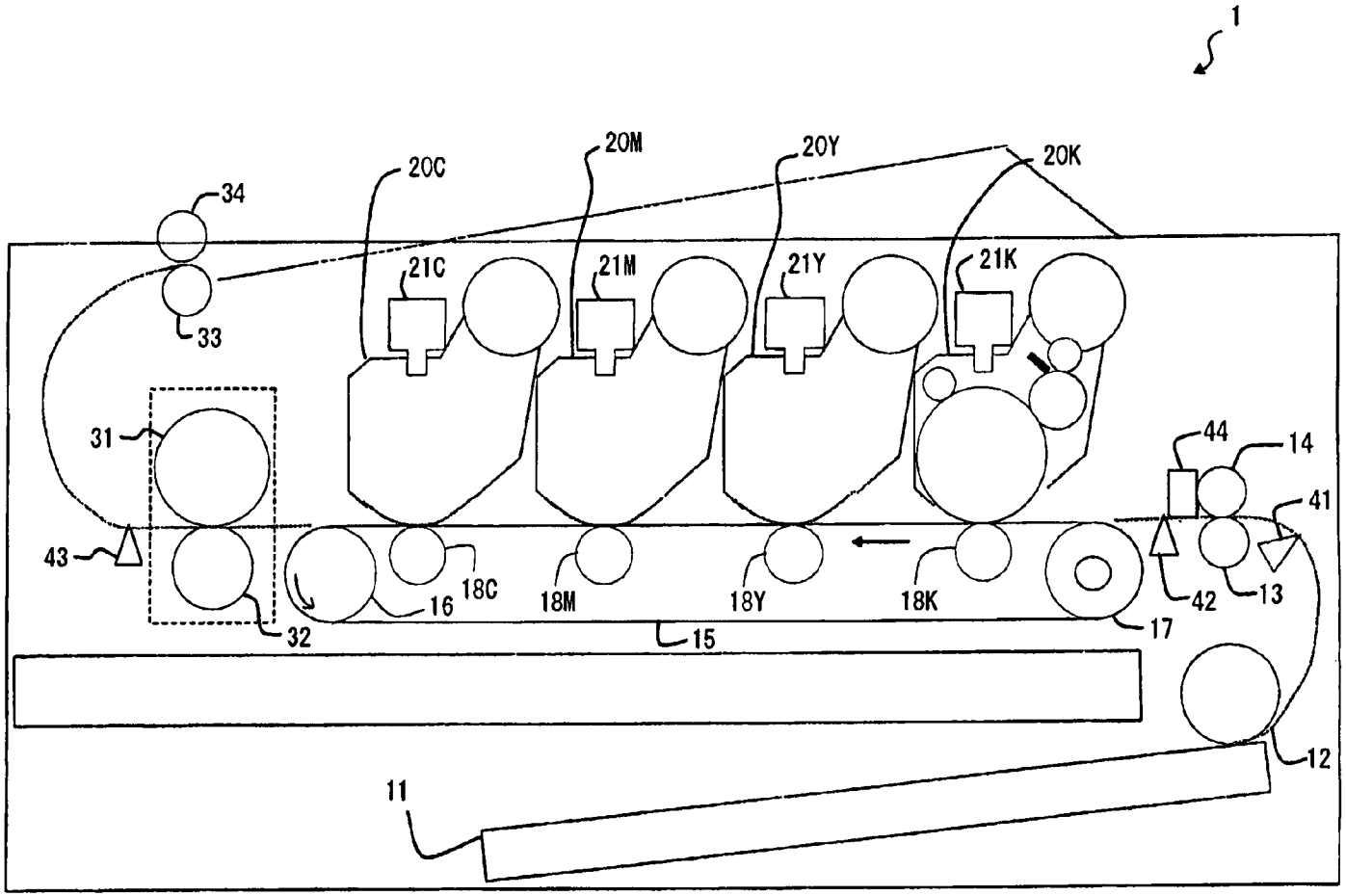
FIG. 1 is a schematic sectional view showing a printer according to a first embodiment of the present invention.

A first embodiment of the present invention will be explained. FIG. 1 is a schematic sectional view showing a printer 1 according to a first embodiment of the present invention. As shown in FIG. 1, the printer 1 includes a sheet receiving portion 11 in a sheet supply tray for storing a recording sheet as a recording medium without an image.

When a sheet supply roller 12 rotates, the recording sheet stored in the sheet supply tray is separated and picked up one by one using a separation tongue member and the likes. Then, transportation rollers 13 and 14 transport the recording sheet to a transfer device forming a medium transportation path at a specific timing.

In the embodiment, the transfer device includes a transportation belt 15 for transporting the recording sheet; a belt drive roller 16 connected to a belt motor (not shown) through a gear for driving the transportation belt 15; a follower roller 17 rotating with the transportation belt 15 for applying tension to the transportation belt 15, so that the transportation belt 15 does not become loose; and transfer rollers 18K, 18Y, 18M, and 18C for applying a transfer voltage according to power supplied from a power source (not shown).

In the embodiment, the printer 1 includes four image forming units 20K, 20Y, 20M, and 20C corresponding to black (K), yellow (Y), magenta (M), and cyan (C), respectively. The image forming units 20K, 20Y, 20M, and 20C face the transfer rollers 18K, 18Y, 18M, and 18C with the transportation belt 15 inbetween. The image forming units 20K, 20Y, 20M, and 20C are arranged in this order along the transportation belt 15 from a supply side to a discharge side of the recording sheet.

When photosensitive drums (described later) rotate and the transportation belt 15 is driven to transport the recording sheet, the image forming units 20K, 20Y, 20M, and 20C form images using toner in each color on the recording sheet on the transportation belt 15.

Figure 2:
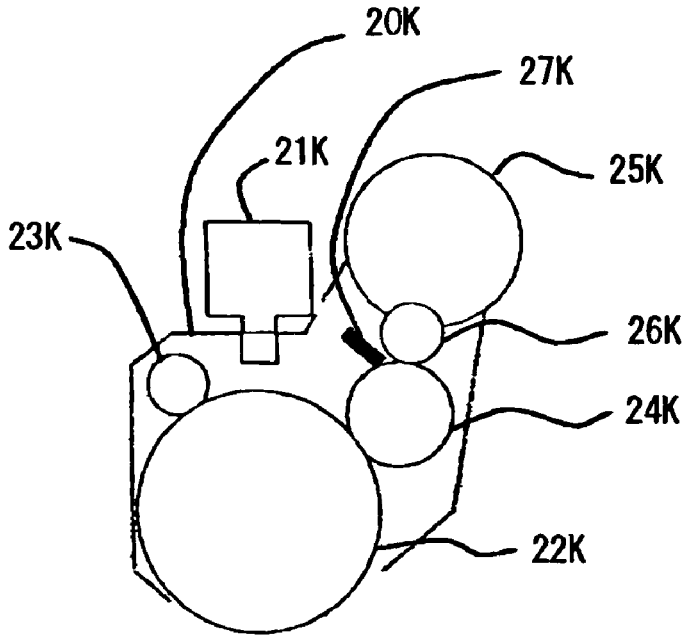
FIG. 2 is a schematic side view showing an image forming unit of the printer according to the first embodiment of the present invention.

In the embodiment, the image forming units 20K, 20Y, 20M, and 20C have an identical configuration, and the image forming unit 20K will be explained in more detail. FIG. 2 is a schematic side view showing the image forming unit 20K of the printer 1 according to the first embodiment of the present invention.

In the embodiment, the image forming unit 20K includes a photosensitive drum 22K and an exposure head 21K for exposing a surface of the photosensitive drum 22K. The exposure head 21K is formed of, for example, an LED (Light Emitting Diode) head and the likes, and is arranged adjacent to the photosensitive drum 22K. The exposure head 21K irradiates light modulated according to image data sent externally on the surface of the photosensitive drum 22K, so that a static latent image is formed on the photosensitive drum 22K.

In the embodiment, the photosensitive drum 22K is formed of a conductive base layer made of aluminum and the likes and a surface layer made of an organic photosensitive member. The photosensitive drum 22K is driven to rotate with a drive motor (not shown), so that the exposure head 21K forms the static latent image on the photosensitive drum 22K. A charging roller 23K is disposed to contact with the photosensitive drum 22K. When a power source (not shown) applies positive potential or negative potential to the charging roller 23K, the charging roller 23K charges the surface of the photosensitive drum 22K at a uniform voltage.

In the embodiment, the image forming unit 20K further includes a developing roller 24K disposed around a circumference of the photosensitive drum 22K. The developing roller 24K is formed of a metal shaft with conductivity and a semi-conductive rubber such as a silicone rubber rolled around the metal shaft. When a power source (not shown) applies positive potential or negative potential to the developing roller 24K, the developing roller 24K develops the static latent image on the photosensitive drum 22K with toner.

In the embodiment, the image forming unit 20K further includes a toner supply roller 26K disposed around the circumference of the developing roller 24K to contact with the developing roller 24K for stably supplying toner to the developing roller 24K. The image forming unit 20K further includes a developing blade 27K disposed around the circumference of the developing roller 24K to contact with the developing roller 24K, so that the developing blade 27K charges toner when a power source (not shown) applies positive potential or negative potential to the developing blade 27K.

In the embodiment, the image forming units 20K, 20Y, 20M, and 20C develop the toner images in each color, respectively. A control unit (not shown) controls the photosensitive drums 22K, 22Y, 22M, and 22C to rotate, so that the transfer rollers 18K, 18Y, 18M, and 18C sequentially transfer the toner images to the recording sheet.

In the embodiment, the image forming units 20K, 20Y, 20M, and 20C and the transfer device sequentially form the images in each color, thereby forming a color image. Then, in the printer 1, the transportation belt 15 sucks the recording sheet through static charge, and transports the recording sheet to a fixing device disposed on a downstream side of the image forming units 20K, 20Y, 20M, and 20C.

In the embodiment, the fixing device includes a heating roller 31 formed of a hollow metal roller covered with an elastic member, and a back-up roller 32 pressing the recording sheet together with the heating roller 31. The back-up roller 32 abuts against the heating roller 31 to form a nip portion therebetween for sandwiching the recording sheet. A heater is disposed inside the heating roller 31 for generating heat with power supplied from a power source (not shown).

In the fixing device, a control unit (not shown) controls the heater to generate heat, so that the heating roller 31 is heated. When the heating roller 31 and the back-up roller 32 rotate to pass the recording sheet through the nip portion, the recording sheet is pressed and heated, so that toner on the recording sheet is melt, thereby thermally fixing the toner images. After the fixing device fixes the image to the recording sheet, discharge rollers 33 and 34 transport and discharge the recording sheet outside, so that the recording sheet is placed on a stacker.

In the embodiment, various sensors are provided on the medium transportation path. For example, the printer 1 is provided with an entrance sensor 41 between the sheet supply roller 12 and the transportation rollers 13 and 14 for detecting the recording sheet thus supplied. Further, the printer 1 is provided with a writing sensor 42 between the transportation rollers 13 and 14 and the image forming unit 20K for detecting a leading edge of the recording sheet to determine a writing timing.

Further, the printer 1 is provided with a discharge sensor 43 on a downstream side of the fixing device for detecting the recording sheet wound around the fixing device. Further, the printer 1 is provided with a sheet thickness sensor 44 for determining a print speed and a fixing temperature.

Figure 3:
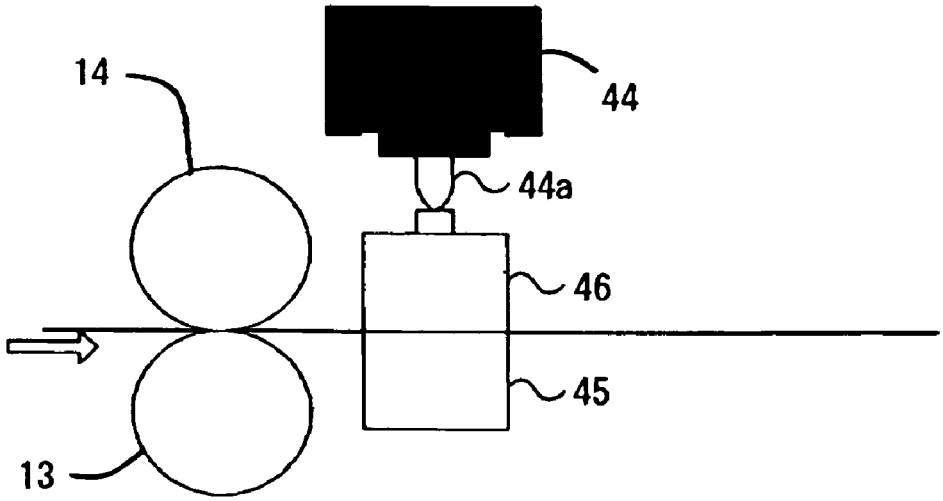
FIG. 3 is a schematic side view showing a sheet thickness sensor of the printer according to the first embodiment of the present invention.

FIG. 3 is a schematic side view showing the sheet thickness sensor 44 of the printer 1 according to the first embodiment of the present invention. As shown in FIG. 3, the printer 1 is provided with a sheet thickness detection unit formed of the sheet thickness sensor 44, a stage 45, and a pickup 46. The sheet thickness sensor 44 is provided with a protrusion 44*a* movable in a vertical direction. The pickup 46 pushes up the protrusion 44*a* to output a signal having a frequency according to an amount of the protrusion 44*a* pushed upward.

In the embodiment, the stage 45 is fixed to the printer 1 for placing the recording sheet transported with the transportation rollers 13 and 14 from a left side to a right side in FIG. 3. The pickup 46 is disposed above the stage 45 to sandwich the recording sheet together with the stage 45, thereby suppressing a warp of the recording sheet.

In the sheet thickness detection unit, when the recording sheet transported with the transportation rollers 13 and 14 from the left side to the right side enters between the stage 45 and the pickup 46, the recording sheet lifts up the pickup 46 by a thickness thereof (note that the stage 45 is fixed). Accordingly, the pickup 46 pushes up the protrusion 44*a* of the sheet thickness sensor 44, thereby outputting a signal according to an amount of the protrusion 44*a* thus pushed upward. In the printer 1, it is possible to measure a thickness of the recording sheet according to a difference between the frequency of the signal output from the sheet thickness sensor 44 when the recording sheet passes through between the stage 45 and the stage 45 and a frequency without the recording sheet.

In the embodiment, the printer 1 is also provided with motors (not shown) for driving various rollers to rotate; rollers (not shown) on the medium transportation path with a distance smaller than a smallest recording sheet; a solenoid (not shown) for switching the medium transportation path; and the likes.

Figure 4:
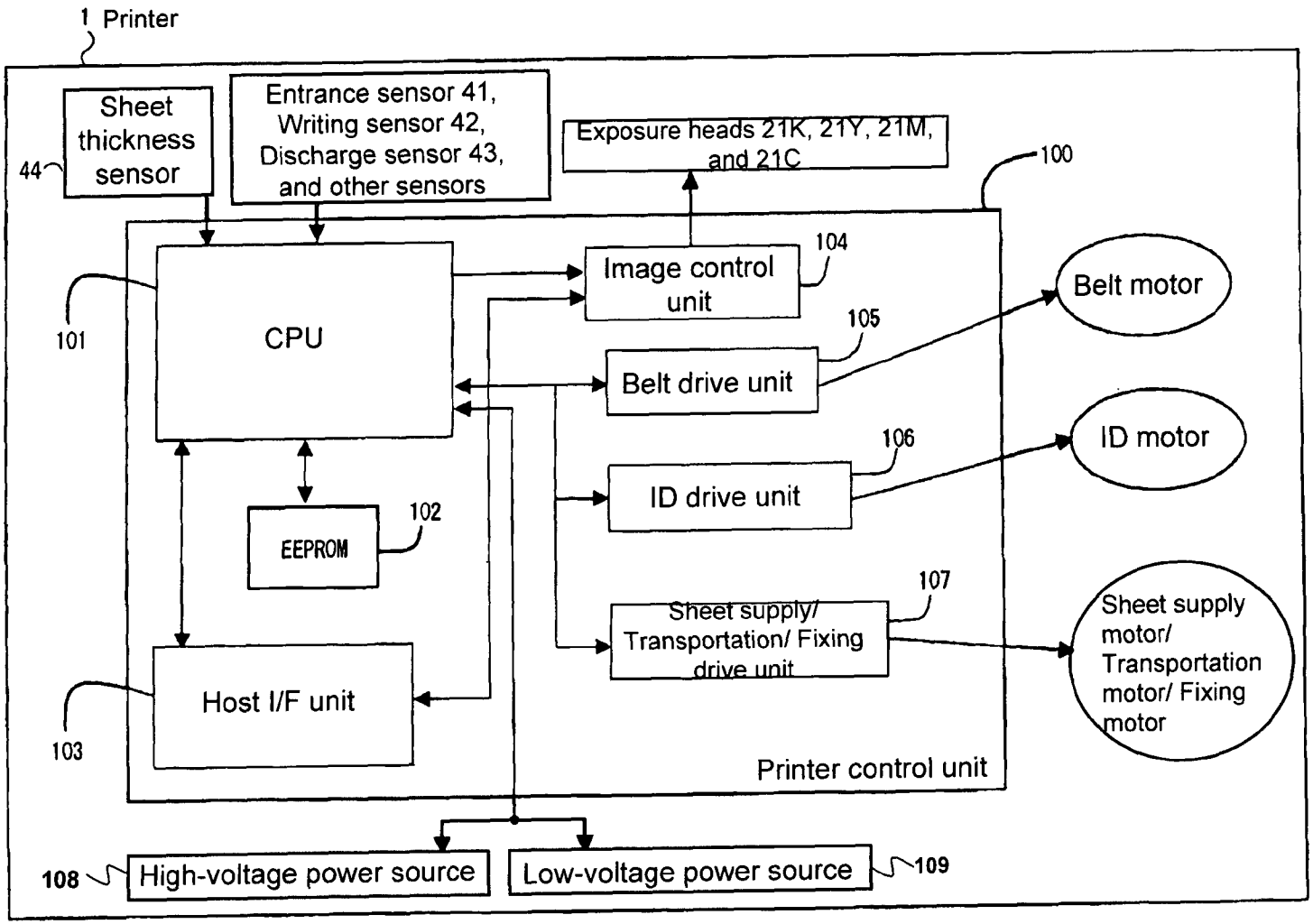
FIG. 4 is a block diagram showing a control system of the printer according to the first embodiment of the present invention.

FIG. 4 is a block diagram showing a control system of the printer 1 according to the first embodiment of the present invention. In the control system, a printer control unit 100 controls an operation of the printer 1.

As shown in FIG. 4, the printer control unit 100 includes a CPU 101 (Central Processing Unit) performing an operation according to a program stored in an ROM (Read Only Memory, not shown); an EEPROM 102 (Electrically Erasable Programmable Read Only Memory) for storing various parameters; a host I/F unit 103 for communicating with a host device (not shown); an image control unit 104 for processing an image according to data received from the host device; a belt drive unit 105 for driving the belt motor to drive the transportation belt 15; an ID drive unit 106 for control an ID motor driving the image forming units 20K, 20Y, 20M, and 20C; and a sheet supply/transportation/fixing drive unit 107 for controlling the sheet supply motor, the transportation motor, and the fixing motor.

In the embodiment, the CPU 101 controls the host I/F unit 103 to supply print data and a control command received from the host device to the image control unit 104. At this time, the CPU 101 controls the belt drive unit 105; the ID drive unit 106; the sheet supply/transportation/fixing drive unit 107; a high-voltage power source 108 for supplying a high-voltage to the charging rollers 23K, 23Y, 23M, and 23C and the transfer rollers 18K, 18Y, 18M, and 18C; and a low-voltage power source 109 for supplying a voltage of 5 V or 24 V to various circuits and various motors.

In the embodiment, the EEPROM 24 stores various parameters necessary for controlling the printer 1, and the CPU 101 retrieves information stored in the EEPROM 24. Under the control of the CPU 101, the host I/F unit 103 communicates with the host device (not shown) through a wire or wireless, so that the host I/F unit 103 receives the print data and the control command from the host device.

In the embodiment, under the control of the CPU 101, the image control unit 104 deploys a font and generates a tone according to the data thus received from the host device through the host I/F unit 103. Further, under the control of the CPU 101, the image control unit 104 sends head data thus created to the exposure heads 21K, 21Y, 21M, and 21C. Under the control of the CPU 101, the belt drive unit 105 outputs a phase signal for driving the belt motor and creates a current value reference, thereby driving the belt motor.

In the embodiment, under the control of the CPU 101, the ID drive unit 106 controls the ID motor for driving the image forming units 20K, 20Y, 20M, and 20C according to a voltage supplied from the low-voltage power source 109. Under the control of the CPU 101, the sheet supply/transportation/fixing drive unit 107 controls the sheet supply motor, the transportation motor, and the fixing motor according to a voltage supplied from the low-voltage power source 109.

As described above, under the control of the printer control unit 100, the printer 1 performs the image forming operation. That is, the printer 1 receives the print data and the control command from the host device connected to the printer 1 through a specific cable or wireless communication through the host I/F unit 103. Upon receiving the print command, under the control of the CPU 101, the sheet supply roller 12 rotates to supply the recording sheet from the sheet receiving portion 11 in the sheet supply tray to the transportation rollers 13 and 14. At this time, under the control of the printer control unit 100, the printer 1 determines whether the sheet supply roller 12 supplies the recording sheet normally according to a detection result of the entrance sensor 41. When the sheet supply roller 12 does not supply the recording sheet normally, the sheet supply operation is repeated.

In the embodiment, under the control of the printer control unit 100, the ID motor of the image forming units 20K, 20Y, 20M, and 20C stars rotating at the same time when the recording sheet is supplied. Upon rotating the ID motor, the belt drive roller 16 starts rotating, so that the transportation belt 15 moves at a specific constant speed. The transportation rollers 13 and 14 transport the recording sheet further, so that the sheet thickness sensor 44 is turned on.

When the sheet thickness sensor 44 is turned on, the printer 1 stops transporting the recording sheet temporarily under the control of the printer control unit 100, so that the sheet thickness sensor 44 measures a thickness of the recording sheet. If the printer 1 does not stop transporting the recording sheet temporarily, the recording sheet may vibrate during the transportation. Accordingly, it is difficult to accurately measure the thickness.

After the sheet thickness sensor 44 measures the thickness of the recording sheet, the fixing device (heating roller 31) is heated up to a fixing temperature suitable for the thickness. Then, under the control of the printer control unit 100, the printer 1 resumes the transportation of the recording sheet to the image forming unit 20K. After a specific period of time since the printer 1 resumes the transportation of the recording sheet, the image forming unit 20K starts exposure of the exposure head 21K to form the static latent image on the photosensitive drum 22K. Further, the developing roller 24K forms the toner image on the photosensitive drum 22K according to the static latent image thus formed.

When the recording sheet reaches a position between the image forming unit 20K and the transfer roller 18K, the printer 1 applies a voltage of about +2,000 V to the transfer roller 18K for sucking toner toward the recording sheet, thereby transferring the toner image to the recording sheet. In the printer 1, the exposure process and the transfer process described above are sequentially performed in the image forming units 20Y, 20M, and 20C, thereby forming the color image on the recording sheet.

After the transfer process is completed, under the control of the printer control unit 100, the printer 1 transports the recording sheet to the fixing device to heat and press the recording sheet, thereby thermally fixing the toner images. After the fixing process, when the leading edge of the recording sheet passes through the discharge sensor 43, the discharge sensor 43 is turned on. Then, the discharge rollers 33 and 34 discharge the recording sheet outside, so that the recording sheet is placed on the specific stacker. Under the control of the printer control unit 100, the printer 1 performs a series of image forming processes described above, so that the color image is formed on the recording sheet.

In the embodiment, the printer 1 determines a process value such as a transfer voltage, a developing voltage, a fixing temperature, and the likes according to the thickness of the recording sheet. Further, the printer 1 performs an operation for reducing a period of time for forming an image on a first one of the recording sheets.

Figure 5:
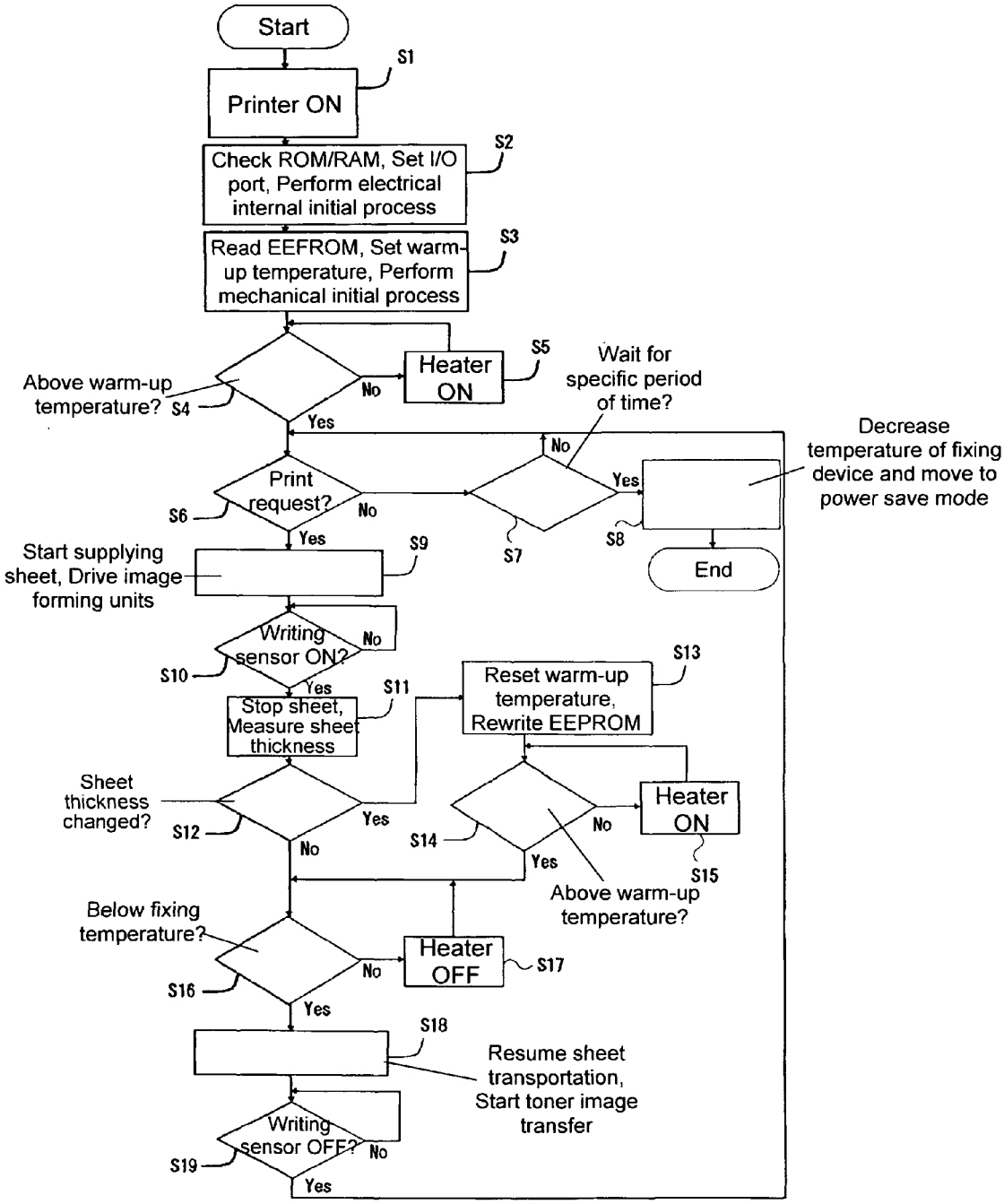
FIG. 5 is a flowchart showing a routine operation of the printer according to the first embodiment of the present invention.

FIG. 5 is a flowchart showing a routine operation of the printer 1 according to the first embodiment of the present invention. The image forming operation includes a routine operation of supplying the recording sheet, a routine operation of transporting the recording sheet, and a routine operation of discharging the recording sheet. Only the routine operation of supplying the recording sheet will be explained here.

In step S1, the printer 1 is turned on, and the CPU 101 starts a program stored in the ROM (not shown). In step S2, the CPU 101 performs an electrical internal initial process such as a hash check of the ROM, a check of an RAM (not shown), and a setting of an I/O port.

In step S3, the CPU 101 determines the fixing temperature with referring to a table stored in the ROM according to sheet thickness data retrieved from the EEPROM 102. At the same time, the CPU 101 sets a warm-up temperature (target temperature) by subtracting a specific temperature (for example, 10° C.) from the fixing temperature.

In the embodiment, the sheet thickness data stored in the EEFROM 102 includes the thickness of the recording sheet measured before the power is turned on, and the thickness of the first one of the recording sheets detected with the sheet thickness detection unit when the sheet supply tray is exchanged. The warm-up temperature is set below an actual fixing temperature. Further, the warm-up temperature is set such that the heater is heated and reaches the fixing temperature when the recording sheet reaches the fixing device after the recording sheet starts being transported. After the electrical internal initial process is completed, under the control of the CPU 101, the printer 1 starts a mechanical initial process such as print density correction and color shift correction among the image forming units 20K, 20Y, 20M, and 20C.

FIG. 6 is a view showing the table stored in the ROM of the printer 1 according to the first embodiment of the present invention. The table contains information regarding a type of recording sheet, a transportation speed according to a range of sheet thickness, the fixing temperature, and the likes. Intuitively, when the recording sheet has a larger thickness, the fixing temperature to be set should increase. In an actual case, as shown in FIG. 6, depending on the thickness of the recording sheet, the fixing temperature is set lower for the recording sheet having a larger thickness.

When the printer 1 supplies the recording sheet having a larger thickness continuously, the recording sheet absorbs heat to a larger extent from a sheet transportation area between the heating roller 31 and the back-up roller 32. Accordingly, it is necessary to heat the heater for a longer period of time. In this case, an edge portion of the heating roller 31 other than the sheet transportation area does not lose heat and tends to be heated excessively, thereby reducing a life of the heating roller 31 and damaging the heating roller 31. Accordingly, in the printer 1, as shown in FIG. 6, when the recording sheet has a larger thickness, the transportation speed decreases and the fixing temperature decreases. Depending on a type of fixing device, the transportation speed and the fixing temperature may be adjusted accordingly, for example, only the transportation speed may decrease.

In step S4, when the printer 1 starts the mechanical initial process, the CPU 101 starts heating the fixing device, and monitors whether the temperature of the fixing device (surface temperature of the heating roller 31) reaches the warm-up temperature. In step S5, when the temperature of the fixing device does not reach the warm-up temperature, the CPU 101 turns on the heater disposed in the heating roller 31. In step S6, when the temperature of the fixing device reaches the warm-up temperature, and further the mechanical initial process is completed, the printer 1 proceeds to a routine of waiting for the print request.

In step S6, it is monitored whether the print request is sent from the host device during an idle state. In the idle state, the printer 1 maintains the fixing device at the warm-up temperature, so that the printing operation can start immediately upon receiving the print request. When the printer 1 receives the print request, the process proceeds to step S9. When the printer 1 does not receive the print request, the printer 1 waits for the print request for a specific period of time in step S7. When the printer 1 does not receive the print request for the specific period of time, the process proceeds to step S8. In step S8, the printer 1 decreases the temperature of the fixing device (surface temperature of the heating roller 31), and moves to a power save mode.

In Step S9, when the printer 1 receives the print request, under the control of the CPU 101, the printer 1 starts supplying the recording sheet; driving the image forming units 20K, 20Y, 20M, and 20C; and driving the belt motor. Note that the printer 1 starts driving the belt motor, so that the photosensitive drums 22K, 22Y, 22M, and 22C rotate more than one rotation before the recording sheet reaches the photosensitive drums 22K, 22Y, 22M, and 22C.

In step S10, the CPU 101 determines whether the writing sensor 42 is turned on. When the writing sensor 42 is turned on, the process proceeds to step S11. In step S11, the recording sheet is stopped temporarily, and the sheet thickness sensor 44 measures the thickness of the recording sheet. Accordingly, it is possible to prevent a problem such as hot off-set and cold off-set when a measurement result does not match to the sheet thickness data stored in the EEFROM 102.

In step S12, it is determined whether the thickness of the recording sheet thus measured matches to the sheet thickness data stored in the EEFROM 102. When the thickness of the recording sheet thus measured matches to the sheet thickness data, the process proceeds to step S16. When the thickness of the recording sheet thus measured does not match to the sheet thickness data, the process proceeds to step S13. In step S13, the CPU 101 changes contents of the EEPROM 102 to the thickness of the recording sheet thus measured. Further, the CPU 101 resets the warm-up temperature set in step S3 to a temperature according to the thickness of the recording sheet thus measured.

In step S14, the CPU 101 determines whether the temperature of the fixing device (surface temperature of the heating roller 31) reaches the temperature newly set. When the temperature of the fixing device does not reach the temperature, the process proceeds to step S15. In step S15, the heater disposed in the heating roller 31 is turned on. When the temperature of the fixing device exceeds the warm-up temperature, or the temperature of the fixing device exceeds the warm-up temperature after the heater is turned on, the process proceeds to step S16.

In step S16, the printer 1 becomes idle until the fixing device is cooled to a temperature according to the thickness of the recording sheet. Note that the printer 1 becomes idle for cooling the fixing device regardless of changing the thickness of the recording sheet, so that it is possible to monitor overshoot regardless of the set temperature of the fixing device.

When the temperature of the fixing device (surface temperature of the heating roller 31) exceeds the fixing temperature thus set, the process proceeds to step S17. In step S17, the heater disposed in the heating roller 31 is turned off to cool the fixing device. When the temperature of the fixing device (surface temperature of the heating roller 31) is within the fixing temperature thus set, the process proceeds to step S18. In step S18, the printer 1 resumes transporting the recording sheet, and starts transferring the toner images to the recording sheet. In step S19, it is determined whether the writing sensor 42 is turned off. When the writing sensor 42 is turned off, the printer 1 waits for a next recording sheet, and the process from step S6 is repeated.

Figure 7:
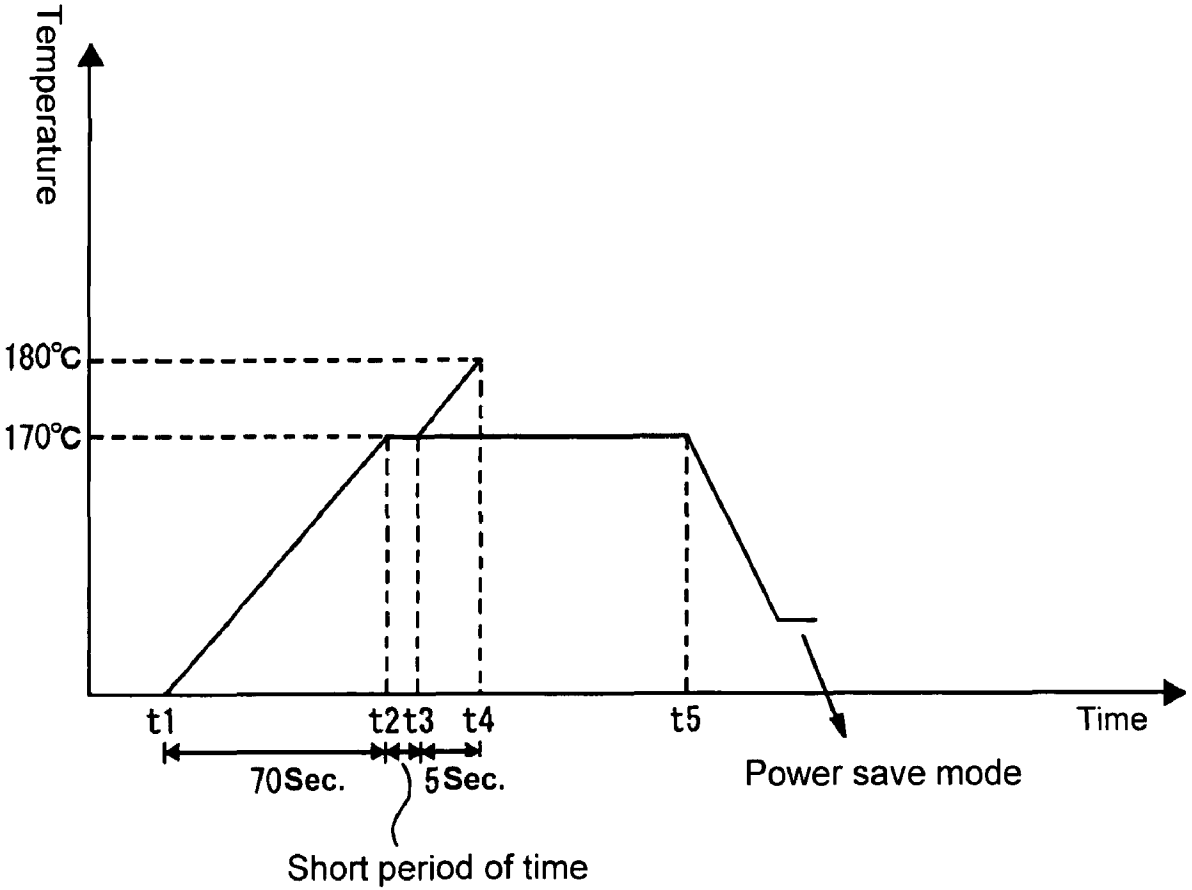
FIG. 7 is a time chart corresponding to the routine operation shown in FIG. 5 according to the first embodiment of the present invention.

FIG. 7 is a time chart corresponding to the routine operation shown in FIG. 5 according to the first embodiment of the present invention. In the time chart, it is assumed that the fixing temperature is set at 180° C., and the warm-up temperature is set at 170° C.

As shown in FIG. 7, the power is turned on at a time t1 (step S1 in FIG. 5), and the temperature of the fixing device (surface temperature of the heating roller 31) reaches the warm-up temperature of 170° C. at a time t2 (step S4 in FIG. 5). The printer 1 determines whether the host device sends the print request within a short period of time from a time t2 to a time t3 (step S6 in FIG. 5). When the host device sends the print request, the printer 1 starts transporting the recording sheet, and increases the temperature of the fixing device (surface temperature of the heating roller 31) to the fixing temperature of 180° C. by a time t4 (step S9 and after in FIG. 5).

As shown in FIG. 7, in the printer 1, it takes about 70 seconds from when the power is turned on to when the temperature of the fixing device reaches the warm-up temperature (from the time t1 to the time t2). Further, it takes about 5 seconds for the temperature of the fixing device to change from the warm-up temperature to the fixing temperature (from the time t3 to the time t4). That is, as described above, the warm-up temperature is set below the actual fixing temperature, and is set such that the heater is heated and reaches the fixing temperature when the recording sheet reaches the fixing device after the recording sheet starts being transported. Especially when the print request is sent, the warm-up temperature is set such that the temperature of the fixing device reaches the fixing temperature in a short period of time. When the warm-up temperature is set exactly at the fixing temperature, the power is wasted during the transportation of the recording sheet before the fixing operation.

When the print request is not sent form the time t2 to the time t3, the printer 1 becomes idle for a specific period of time from the time t3 to a time t5, for example, about 30 minutes (step S7 in FIG. 5). After the specific period of time, when the print request is still not sent, the printer 1 decreases the temperature of the fixing device (surface temperature of the heating roller 31), and moves to a power save mode (step S8 in FIG. 5).

As described above, in the printer 1, after the warm-up temperature is set and the fixing device starts heating, the thickness of the recording sheet newly measured with the sheet thickness sensor 44 is compared with the thickness of the recording sheet indicated by the sheet thickness data stored in the EEPROM 102, thereby determining whether to change the warm-up temperature. Accordingly, when the recording sheet different from a recommended sheet is used, and it is determined that the warm-up temperature does not need to be changed as a result of the sheet thickness detection after the power is turned on or the printer 1 returns from the sleep state, it is not necessary to reset the warm-up temperature. As a result, in the printer 1, it is possible to perform the printing operation in a short period of time (waiting time) without a problem such as hot off-set and cold off-set.

In an actual case, the thickness of the recording sheet or a type thereof is not frequently changed. Further, the recording sheet stored in the sheet supply sheet is not frequently changed when the power is turned off. In this case, the sheet thickness data for various types may be stored in the EEPROM 102 in advance, and the temperature of the fixing device (surface temperature of the heating roller 31) may increase up to the warm-up temperature according to the value of the sheet thickness data. Accordingly, it is possible to reduce a period of time necessary for forming an image on a first one of the recording sheets after the power is turned on or the printer 1 returns from the sleep state.

Figure 8:
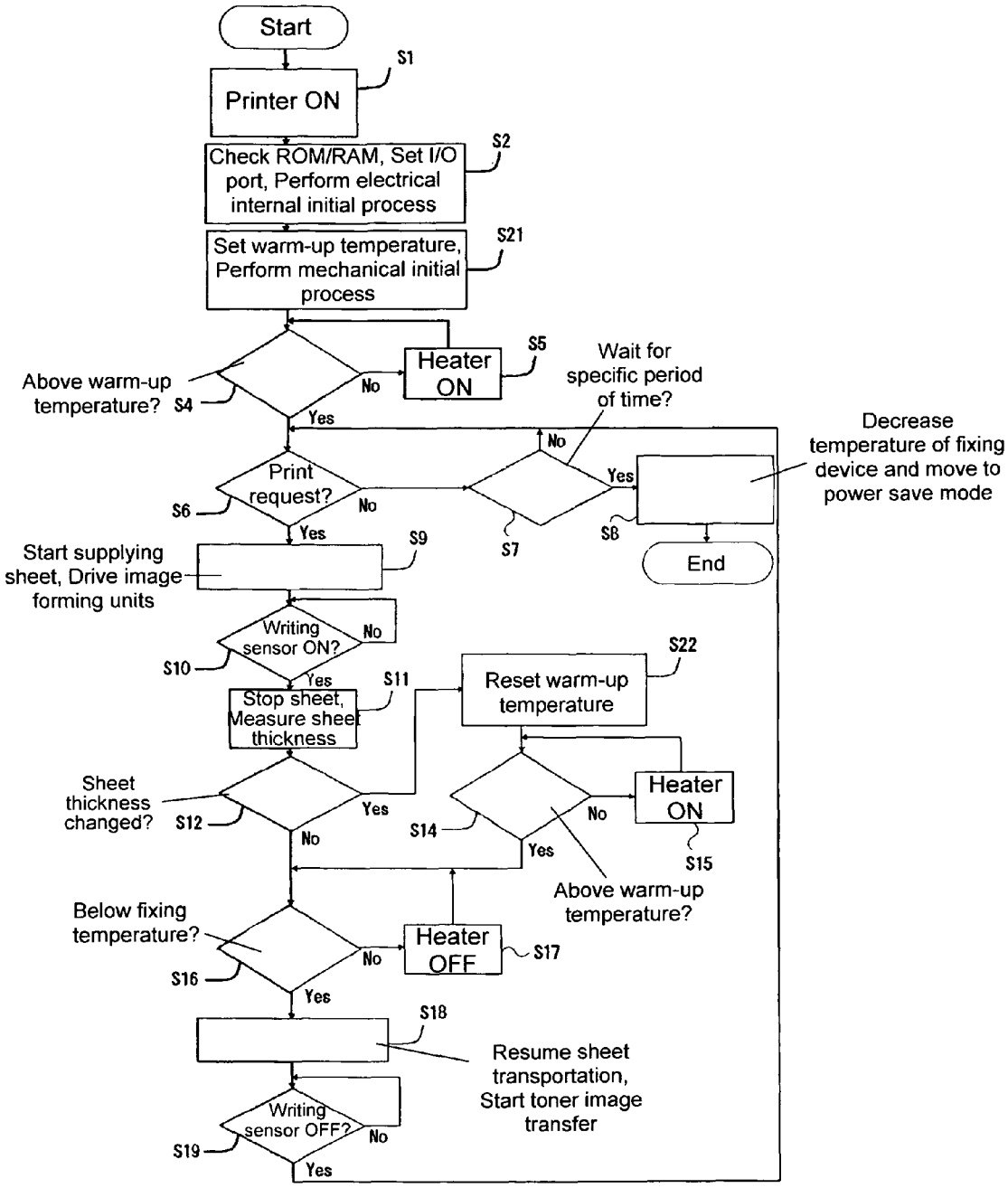
FIG. 8 is a flowchart showing another routine operation of the printer according to the first embodiment of the present invention.

More specifically, instead of those shown in FIG. 5, the printer 1 may perform a series of steps shown in FIG. 8 on the first one of the recording sheets. FIG. 8 is a flowchart showing another routine operation of the printer 1 according to the first embodiment of the present invention.

As shown in FIG. 8, after step S1 and step S2, in step S21, the CPU 101 sets the warm-up temperature at, for example, 170° C. That is, not similar to step S3 shown in FIG. 5, the printer 1 does not set the warm-up temperature with referring to the table stored in the ROM according to the sheet thickness data retrieved from the EEPROM 102. Instead, the printer 1 sets the warm-up temperature corresponding to a lowest fixing temperature in the table stored in the ROM. In other words, the printer 1 sets the warm-up temperature corresponding to the recording sheet to be fixed at the lowest fixing temperature among the recording sheets detectable with the sheet thickness sensor 44.

Then, the printer 1 performs the process from step S4 to S12. When the thickness of the recording sheet is changed, the process proceeds to step S22. In step S22, the CPU 101 resets the warm-up temperature corresponding to the thickness of the recording sheet thus changed. At this time, the printer 1 does not change the contents of the EEPROM 102 to the thickness of the recording sheet thus detected. Then, the printer 1 performs the process from step S14 to step S19, thereby completing the process.

As described above, the printer 1 does not set the warm-up temperature according to the sheet thickness data retrieved from the EEPROM 102. Instead, the printer 1 sets the warm-up temperature corresponding to the recording sheet to be fixed at the lowest fixing temperature among the recording sheets detectable with the sheet thickness sensor 44. Afterward, it is determined whether to change the warm-up temperature according to the thickness of the recording sheet newly detected with the sheet thickness sensor 44. Accordingly, it is possible to simplify the process and perform the process suitable for an actual situation in which the thickness of the recording sheet or the type thereof is not changed frequently.

In this case, when the thickness of the recording sheet is changed in the printer 1, it is necessary to change the fixing temperature according to the thickness thus changed. In general, the temperature of the fixing device increases at about 2° C./sec. Accordingly, the process time loses just one to two seconds, thereby performing the printing operation at a substantially same speed.

As described above, in the embodiment, after the warm-up temperature is set and the fixing device starts being heated under the control of the CPU 101, it is determined whether to change the warm-up temperature according to the thickness of the recording sheet newly detected with the sheet thickness sensor 44. Accordingly, it is possible to significantly reduce the time for forming an image on the first one of the recording sheets after the power is turned on or the printer 1 returns from the sleep state.

In the embodiment, it is assumed that the warm-up temperature is set lower than the fixing temperature by 10° C., and the warm-up temperature is not limited thereto. Further, in FIG. 7, the temperature increases linearly from the time t1 to the time t2 and from the time t3 to the time t4. In an actual case, the temperature increases depending on fixing device.

Second Embodiment

A second embodiment of the present invention will be explained next. In the second embodiment, as a modified version of the first embodiment, a mechanism is provided for lifting up the sheet receiving portion in the sheet supply tray, so that it is possible to confirm whether the recording sheet is changed. Components in the second embodiment similar to those in the first embodiment are designated with the same reference numerals, and explanations thereof are omitted.

Figure 9:
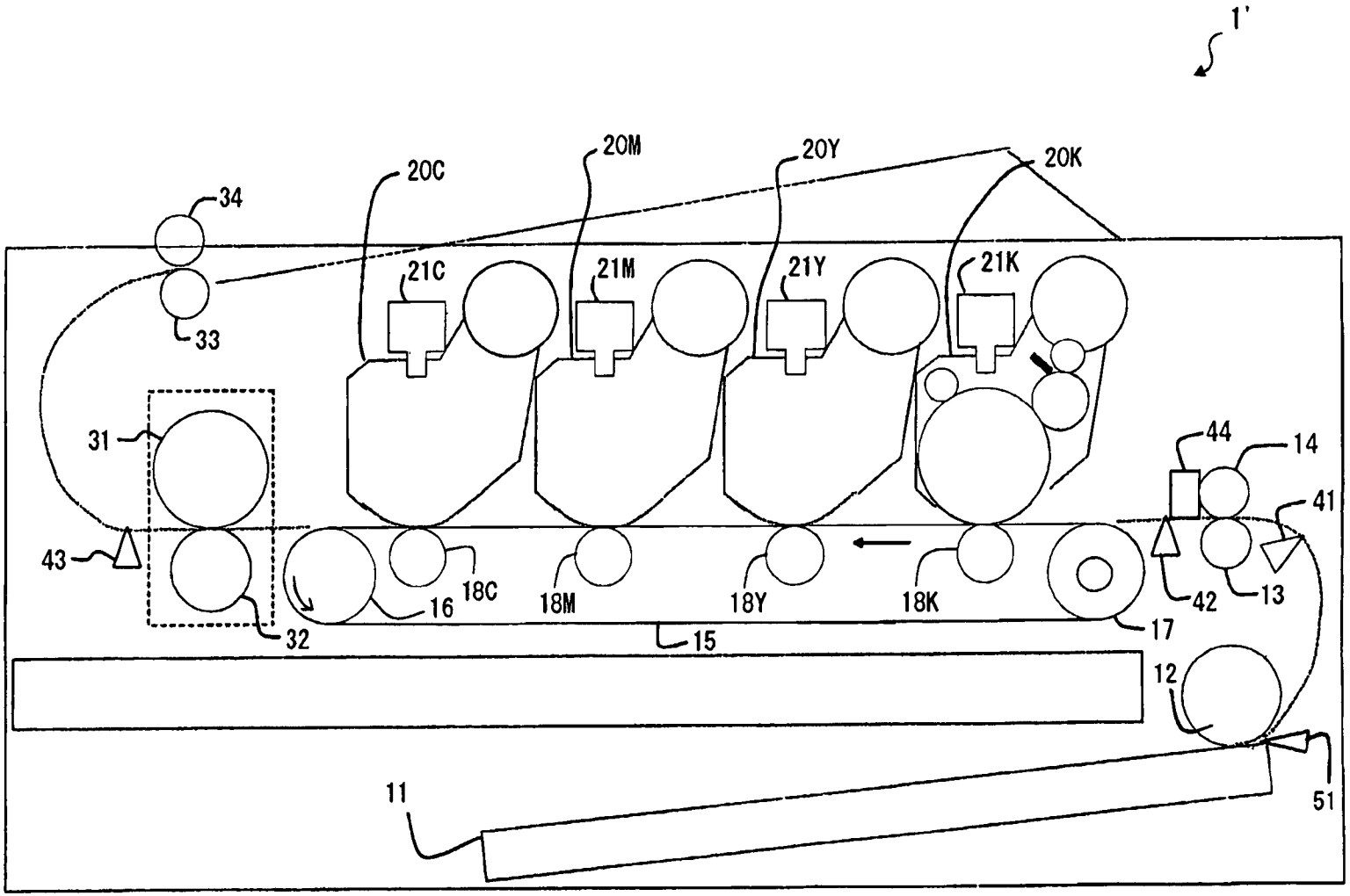
FIG. 9 is a schematic sectional view showing a printer according to a second embodiment of the present invention.

FIG. 9 is a schematic sectional view showing a printer 1' according to the second embodiment of the present invention. In addition to the components in the printer 1 shown in FIG. 1, the printer 1' is provided with a lift-up sensor 51 adjacent to the sheet receiving portion 11. The lift-up sensor 51 may be formed of, for example, a photo interrupter.

Figure 10:
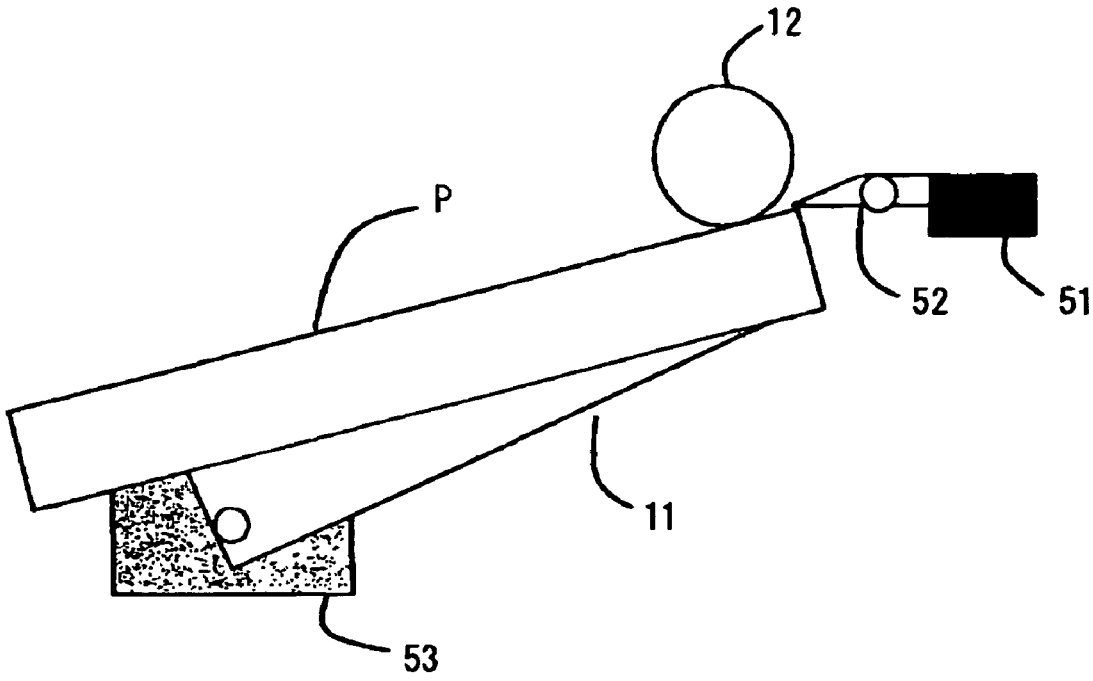
FIG. 10 is a schematic side view showing a lift-up sensor of the printer according to the second embodiment of the present invention.

FIG. 10 is a schematic side view showing the lift-up sensor 51 of the printer 1' according to the second embodiment of the present invention. As shown in FIG. 10, a lever 52 is attached to the lift-up sensor 51 for blocking infrared light. The lever 52 is situated at a position contacting with a front edge of a recording sheet P placed on the sheet receiving portion 11, and is rotatable around a shaft disposed at a middle portion thereof. When the recording sheet P is pressed against the sheet supply roller 12, the lever 52 blocks the photo interrupter constituting the lift-up sensor 51, so that the lift-up sensor 51 is turned on.

In the embodiment, the sheet receiving portion 11 lifts the recording sheet upward. When the sheet supply tray is detached from the printer 1, a coupling of the sheet receiving portion 11 with respect to the sheet supply tray is disconnected, so that the sheet receiving portion 11 lowers. Further, the sheet receiving portion 11 is provided with a lift-up motor 53. When the lift-up sensor 51 is turned on, the lift-up motor 53 rotates in a left side according to a signal output from the CPU 101, so that the sheet receiving portion 11 is lifted upward. When the lift-up sensor 51 is turned off, the lift-up motor 53 stops and completes lifting up the sheet receiving portion 11.

Figure 11:
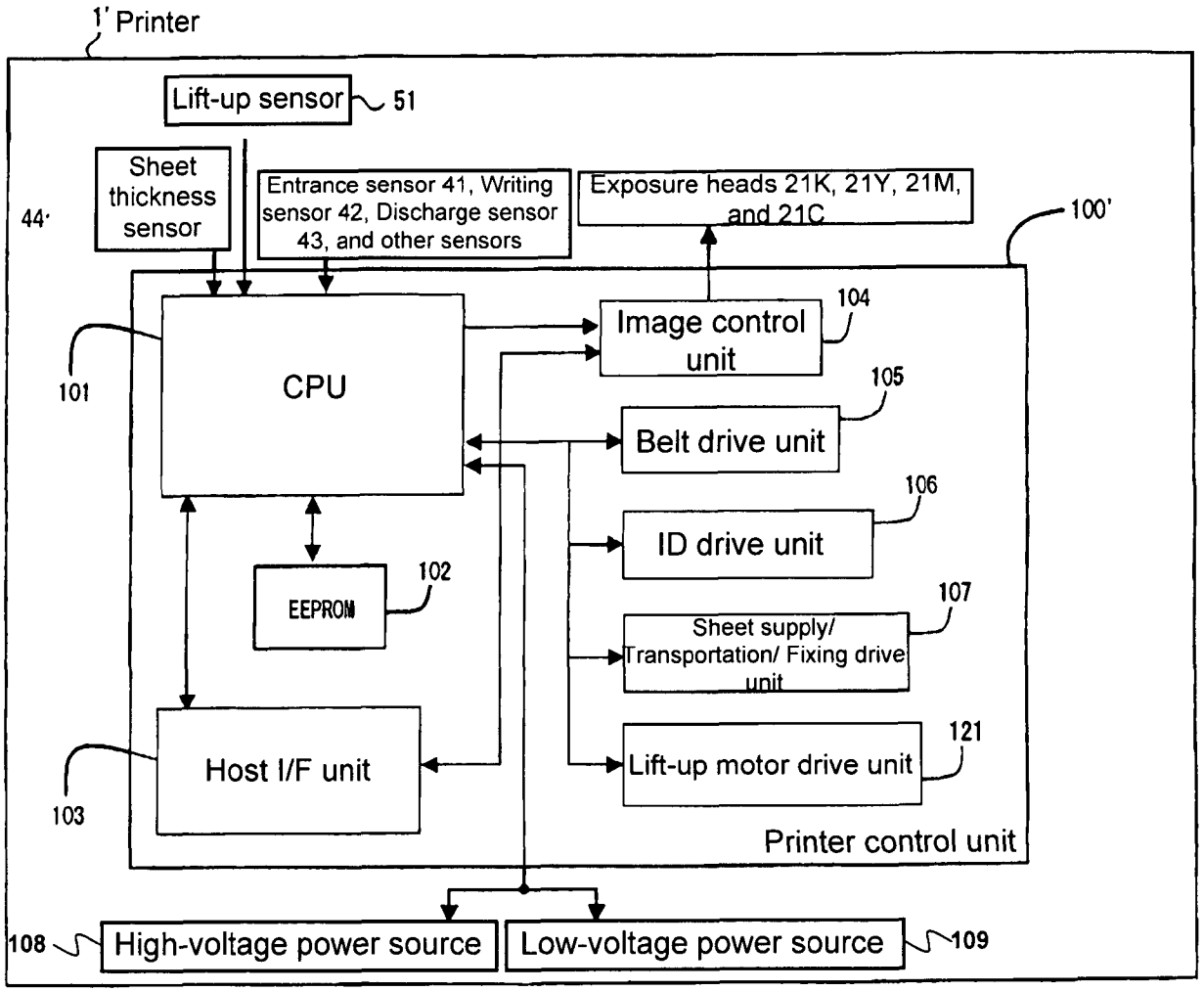
FIG. 11 is a block diagram showing a control system of the printer according to the second embodiment of the present invention.

FIG. 11 is a block diagram showing a control system of the printer 1' according to the second embodiment of the present invention. As shown in FIG. 11, the control system includes a printer control unit 100', and the CPU 101 of the printer control unit 100' receives a signal from the lift-up sensor 51. The CPU 100 controls a lift-up motor drive unit 121 driving the lift-up motor 53 according to a detection result of the lift-up sensor 51.

In the embodiment, the printer 1' performs the printing operation, so that it is possible to significantly reduce the time for forming an image on the first one of the recording sheets after the power is turned on or the printer 1' returns from the sleep state.

Different from the first embodiment, in the second embodiment, when the power is turned on, the warm-up temperature is set according to the sheet thickness data stored in the EEPROM 102. At the same time, it is determined whether the recording sheet is changed according to the detection result of the lift-up sensor 51 without performing the measurement of the sheet thickness.

Figure 12:
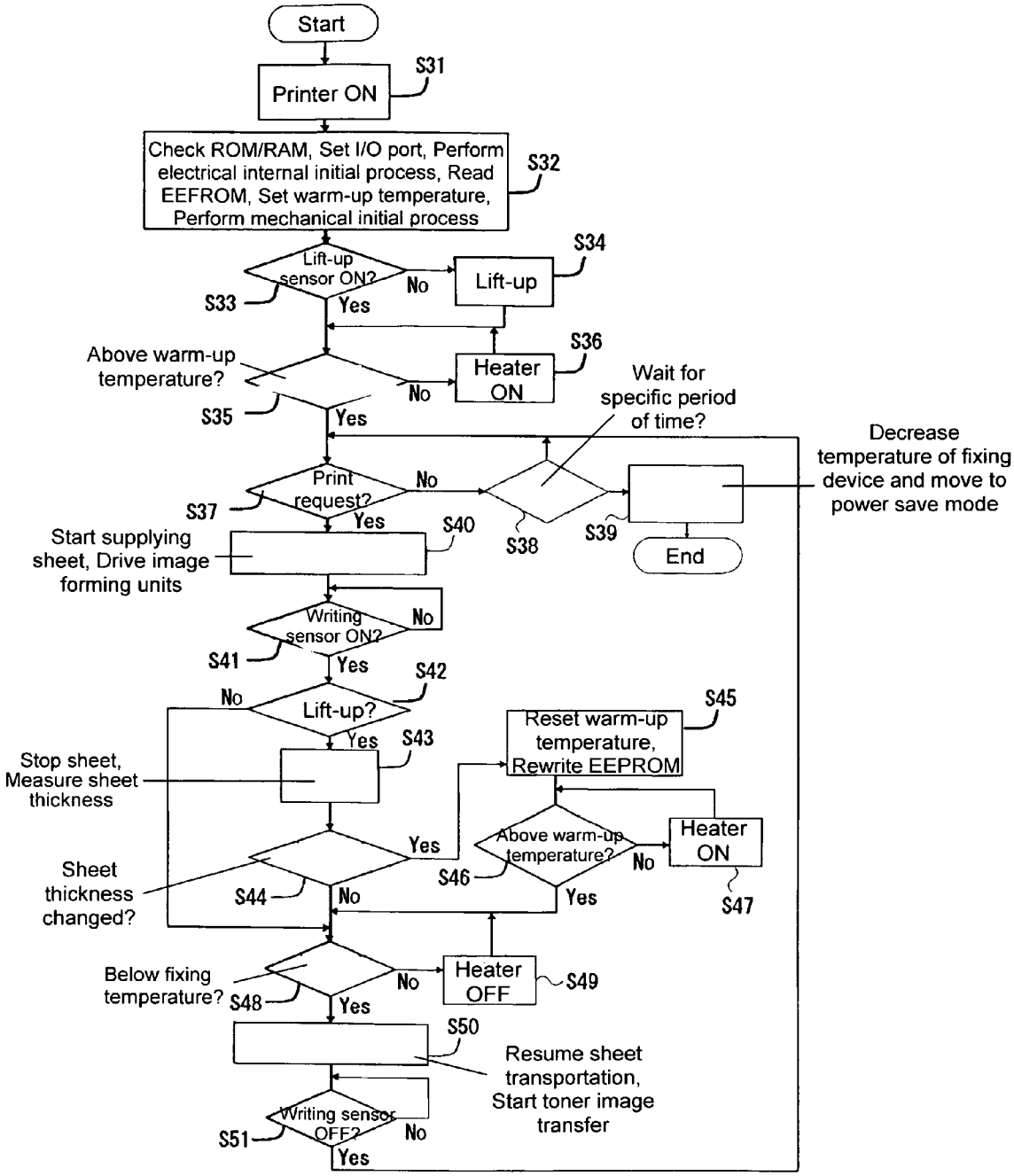
FIG. 12 is a flowchart showing a routine operation of the printer according to the second embodiment of the present invention.

More specifically, an operation shown in FIG. 12 is performed. FIG. 12 is a flowchart showing a routine operation of the printer 1' according to the second embodiment of the present invention. The image forming operation includes a routine operation of supplying the recording sheet, a routine operation of transporting the recording sheet, and a routine operation of discharging the recording sheet. Only the routine operation of supplying the recording sheet will be explained here.

In step S31, the printer 1' is turned on, and the CPU 101 starts a program stored in the ROM (not shown). In step S32, the CPU 101 performs an electrical internal initial process such as a hash check of the ROM, a check of an RAM (not shown), a setting of an I/O port. Further, the CPU 101 determines the fixing temperature with referring to a table stored in the ROM according to the sheet thickness data retrieved from the EEPROM 102. At the same time, the CPU 101 sets the warm-up temperature by subtracting a specific temperature (for example, 10° C.) from the fixing temperature. After the electrical internal initial process is completed, under the control of the CPU 101, the printer 1' starts the mechanical initial process such as print density correction and color shift correction among the image forming units 20K, 20Y, 20M, and 20C.

In step S33, the printer 1' determines whether the lift-up sensor 51 is tuned on. When the lift-up sensor 51 is tuned on and the sheet receiving portion 11 is lowered, the process proceeds to step S34. In step S34, the CPU 101 controls the sheet supply roller 121 to lift up the sheet receiving portion 11, and sets a request flag of sheet thickness detection associated with the exchange of the recording sheet in the sheet supply tray. That is, when the lift-up sensor 51 is tuned on and the sheet receiving portion 11 is lowered, it is indicated that the recording sheet may be exchanged. Accordingly, when the lift-up sensor 51 is tuned on and the sheet receiving portion 11 is lowered, in the printer 1', the request flag of sheet thickness detection is set.

More specifically, when the lift-up sensor 51 is tuned on and the sheet receiving portion 11 is lowered, it is indicated that the sheet supply tray is detached and the recording sheet may be exchanged. In the printer 1', accordingly, when the lift-up sensor 51 is tuned on and the sheet receiving portion 11 is lowered, the request flag of sheet thickness detection is set.

In step S35, when the printer 1 starts the mechanical initial process, the CPU 101 starts heating the fixing device, and monitors whether the temperature of the fixing device (surface temperature of the heating roller 31) reaches the warm-up temperature. In step S36, when the temperature of the fixing device does not reach the warm-up temperature, the CPU 101 turns on the heater disposed in the heating roller 31. In step S37, when the temperature of the fixing device reaches the warm-up temperature, and further the mechanical initial process is completed, the printer 1 proceeds to a routine of waiting for a print request.

In step S37, it is monitored whether the print request is sent from the host device during an idle state. When the printer 1 receives the print request, the process proceeds to step S40. When the printer 1 does not receive the print request, the printer 1 waits for the print request for a specific period of time in step S38. When the printer 1 does not receive the print request for the specific period of time, the process proceeds to step S39. In step S39, the printer 1 decreases the temperature of the fixing device (surface temperature of the heating roller 31), and moves to the power save mode.

In Step S40, when the printer 1 receives the print request, under the control of the CPU 101, the printer 1 starts supplying the recording sheet, driving the image forming units 20K, 20Y, 20M, and 20C, and driving the belt motor. In step S41, the CPU 101 determines whether the writing sensor 42 is turned on. When the writing sensor 42 is turned on, the process proceeds to step S42. In step S42, the CPU 101 determines whether the sheet receiving portion 11 has been lifted up with referring to the request flag of sheet thickness detection. When the sheet receiving portion 11 has not been lifted up, the process proceeds to step S48. When the sheet receiving portion 11 has been lifted up, the process proceeds to step S43.

In step S43, the recording sheet is stopped temporarily, and the sheet thickness sensor 44 measures the thickness of the recording sheet. That is, when the request flag of sheet thickness detection is set, it is indicated that the sheet supply tray is detached and the recording sheet is exchanged, so that the sheet thickness is measured. On the other hand, when the request flag of sheet thickness detection is not set, it is indicated that the sheet supply tray is not detached and the recording sheet is not exchanged, so that the process proceeds without measuring the sheet thickness.

In step S44, it is determined whether the thickness of the recording sheet thus measured matches to the sheet thickness data stored in the EEFROM 102. When the thickness of the recording sheet thus measured matches to the sheet thickness data, the process proceeds to step S48. When the thickness of the recording sheet thus measured does not match to the sheet thickness data, the process proceeds to step S45. In step S45, the CPU 101 changes contents of the EEPROM 102 to the thickness of the recording sheet thus measured. Further, the CPU 101 resets the warm-up temperature set in step S32 to a temperature according to the thickness of the recording sheet thus measured.

In step S46, the CPU 101 determines whether the temperature of the fixing device (surface temperature of the heating roller 31) reaches the temperature newly set. When the temperature of the fixing device does not reach the temperature, the process proceeds to step S47. In step S47, the heater disposed in the heating roller 31 is turned on. When the temperature of the fixing device reaches the temperature, or the temperature of the fixing device reaches the temperature after the heater is turned on, the process proceeds to step S48.

In step S48, the printer 1 becomes idle until the fixing device is cooled to the fixing temperature according to the thickness of the recording sheet. Note that the printer 1 becomes idle for cooling the fixing device regardless of changing the thickness of the recording sheet, so that it is possible to monitor overshoot regardless of the set temperature of the fixing device.

When the temperature of the fixing device (surface temperature of the heating roller 31) exceeds the fixing temperature thus set, the process proceeds to step S49. In step S49, the heater disposed in the heating roller 31 is turned off to cool the fixing device. When the temperature of the fixing device (surface temperature of the heating roller 31) is within the fixing temperature thus set, the process proceeds to step S50. In step S50, the printer 1 resumes transporting the recording sheet, and starts transferring the toner images to the recording sheet. In step S51, it is determined whether the writing sensor 42 is turned off. When the writing sensor 42 is turned off, the printer 1 waits for a next recording sheet, and the process from step S37 is repeated.

In the embodiment, the printer 1' performs the routine operation of supplying the recording sheet described above. When the recording sheet different from the recommended sheet is used, the sheet receiving portion 11 is not lifted up upon turning on the power. When it is determined that the recording sheet is not changed, it is not necessary to reset the warm-up temperature for the printing operation after the power is turned on or the printer 1' returns from the sleep state. Accordingly, in the printer 1', it is possible to perform the printing operation in a short period of waiting time without causing a problems such as hot off-set and cold off-set.

As described above, in the embodiment, after the warm-up temperature is set and the fixing device starts being heated under the control of the CPU 101, it is determined whether to change the warm-up temperature according to the detection result of the lift-up sensor 51. Accordingly, it is possible to significantly reduce the time for forming an image on the first one of the recording sheets with the simple configuration after the power is turned on or the printer 1 returns from the sleep state.

The present invention is not limited to the embodiments described above. In the embodiments described above, the warm-up temperature is set according to the thickness of the recording sheet. Alternatively, the warm-up temperature may be set according to a type of recording sheet other than the thickness thereof.

Further, in the second embodiment, the warm-up temperature is set with referring to the table stored in the ROM according to the sheet thickness data retrieved from the EEPROM 102. When the warm-up temperature is set at the specific constant temperature as shown in FIG. 8, it is possible to utilize the lift-up mechanism of the sheet receiving portion 11.

Further, in the embodiments, the printer 1 or the printer 1' is provided with the exposure heads 21K, 21Y, 21M, and 21C formed of the LED heads, and may be provided with a laser exposure unit having a small laser and a polygon mirror. A composition of developer is not specified, and may be powder toner or liquid toner applicable to the thermal fixing process.

Further, in the embodiments, the printer is explained as an image forming apparatus for forming an image on the specific recording sheet using toner. The present invention may be applicable to other image forming apparatus for forming an image such as a printer, a facsimile, a copier and a multi-function product having other functions.

The disclosure of Japanese Patent Applications No. 2006-345706, filed on Dec. 22, 2006, is incorporated in the application by reference.

While the invention has been explained with reference to the specific embodiments of the invention, the explanation is illustrative and the invention is limited only by the appended claims.

What is claimed is:

1. An image forming apparatus for forming an image on a recording medium, comprising:

a fixing device for thermally fixing the image on the recording medium;

a medium type detection unit for detecting a type of the recording medium;

a temperature adjusting unit for adjusting a temperature of the fixing device according to the type of the recording medium; and a storage unit for storing data indicating the type of the recording medium, wherein said temperature adjusting unit sets a target temperature according to the type of the recording medium stored in the storage unit and starts heating the fixing device, and said temperature adjusting unit determines whether to change the target temperature according to a comparison result between a type of the recording medium newly detected by the medium type detection unit and the type of the recording medium indicated by the data stored in the storage unit after the temperature adjusting unit sets the target temperature and starts heating the fixing device.

2. The image forming apparatus according to claim 1, wherein said temperature adjusting unit changes contents of the storage unit to data indicating the type of the recording medium newly detected by the medium type detection when the temperature adjusting unit determines that the type of the recording medium newly detected by the medium type detection unit is different from the type of the recording medium indicated by the data stored in the storage unit, said temperature adjusting unit resetting the target temperature according to the type of the recording medium newly detected by the medium type detection.

3. An image forming apparatus for forming an image on a recording medium, comprising:

a fixing device for thermally fixing the image on the recording medium;

a medium type detection unit for detecting a type of the recording medium; and a temperature adjusting unit for adjusting a temperature of the fixing device according to the type of the recording medium, wherein said temperature adjusting unit sets a target temperature according to a recording medium to be fixed at a lowest temperature among the recording media detectable with the medium type detection unit and starts heating the fixing device, said temperature adjusting unit determining whether to change the target temperature according to a type of the recording medium newly detected by the medium type detection unit after the temperature adjusting unit sets the target temperature and starts heating the fixing device.

4. The image forming apparatus according to claim 3, wherein said temperature adjusting unit resets the target temperature according to the type of the recording medium newly detected by the medium type detection when the medium type detection detects that the type of the recording medium is changed.

5. An image forming apparatus for forming an image on a recording medium, comprising:

a fixing device for thermally fixing the image on the recording medium;

a medium type detection unit for detecting a type of the recording medium;

a temperature adjusting unit for adjusting a temperature of the fixing device according to the type of recording medium;

a medium storage unit for storing the recording medium; and a detachment detection unit for detecting whether the medium storage unit is detached, wherein said temperature adjusting unit sets a target temperature and starts heating the fixing device, said temperature adjusting unit determining whether to change the target temperature according to a detection result of the detachment detection unit after the temperature adjusting unit sets the target temperature and starts heating the fixing device.

6. The image forming apparatus according to claim 5, further comprising a storage unit for storing data indicating the type of the recording medium, said temperature adjusting unit setting the target temperature according to the type of the recording medium stored in the storage unit and starts heating the fixing device, said temperature adjusting unit not changing the target temperature when the detachment detection unit detects that the medium storage unit is not detached after the temperature adjusting unit sets the target temperature and starts heating the fixing device, said temperature adjusting unit determining whether to change the target temperature according to a comparison result between a type of the recording medium newly detected by the medium type detection unit and the type of the recording medium indicated by the data stored in the storage unit after the temperature adjusting unit sets the target temperature and starts heating the fixing device.

7. The image forming apparatus according to claim 6, wherein said temperature adjusting unit changes contents of the storage unit to data indicating the type of the recording medium newly detected by the medium type detection when the temperature adjusting unit determines that the type of the recording medium newly detected by the medium type detection unit is different from the type of the recording medium indicated by the data stored in the storage unit, said temperature adjusting unit resetting the target temperature according to the type of the recording medium newly detected by the medium type detection.

8. The image forming apparatus according to claim 5, wherein said temperature adjusting unit sets the target temperature according to a recording medium to be fixed at a lowest temperature among the recording media detectable with the medium type detection unit and starts heating the fixing device, said temperature adjusting unit not changing the target temperature when the detachment detection unit detects that the medium storage unit is not detached after the temperature adjusting unit sets the target temperature and starts heating the fixing device, said temperature adjusting unit determining whether to change the target temperature according to a comparison result between a type of the recording medium newly detected by the medium type detection unit and the type of the recording medium indicated by the data stored in the storage unit after the temperature adjusting unit sets the target temperature and starts heating the fixing device.

9. The image forming apparatus according to claim 8, wherein said temperature adjusting unit resets the target temperature according to the type of the recording medium newly detected by the medium type detection when the medium type detection detects that the type of the recording medium is changed.

* * * * *